United States Patent [19]

Hawthorne

[11] Patent Number: 4,785,291

[45] Date of Patent: Nov. 15, 1988

[54] DISTANCE MONITOR ESPECIALLY FOR CHILD SURVEILLANCE

[76] Inventor: Candy C. Hawthorne, 4616 Esparto Rd., Woodland Hills, Calif. 91364

[21] Appl. No.: 22,994

[22] Filed: Mar. 6, 1987

[51] Int. Cl.[4] ..... G08B 21/00

[52] U.S. Cl. ..... 340/573; 340/539; 340/572; 340/691; 340/815.03; 342/125

[58] Field of Search ..... 340/573, 539, 540, 572, 340/691, 815.03; 342/125, 118

[56] References Cited

U.S. PATENT DOCUMENTS 3,796,951 3/1974 Joseph ..... 340/815.03
4,593,273 6/1986 Narcisse ..... 340/539

FOREIGN PATENT DOCUMENTS 2913563 10/1988 Fed. Rep. of Germany .

*Primary Examiner*—Glen R. Swann, III
*Attorney, Agent, or Firm*—William T. O'Neil

[57] ABSTRACT

Monitoring apparatus including an unmodulated radio-frequency transmitter carried by or affixed to the person to be monitored and receiver/monitor apparatus at a monitoring location for providing quantized visual and audible indicia based on received signal strength. The receiver AGC level, being a function of received signal strength, provides the variable which determines the repetition rate of tone bursts and the number of LED bar visual indicia lighted within an array of such LED bars. The response levels of those indicia are then a function of the distance between transmitter and receiver. Movement of the child (for example) beyond a predetermined range is immediately detected by a person at the receiver location. Circuitry is provided for presetting the maximum allowable range before alarm is instituted.

4 Claims, 5 Drawing Sheets

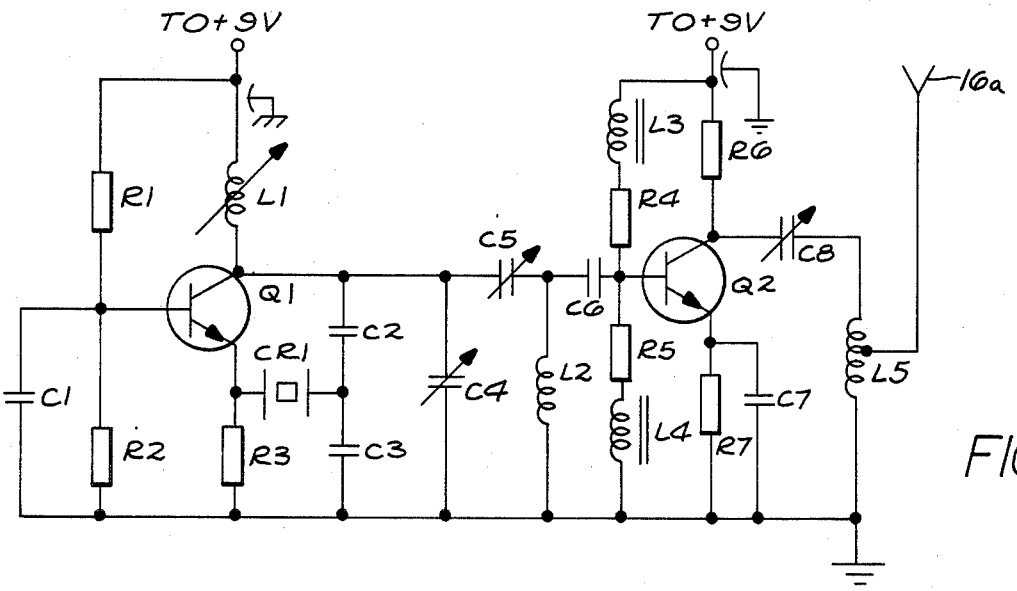
FIG. 3
FIG. 5
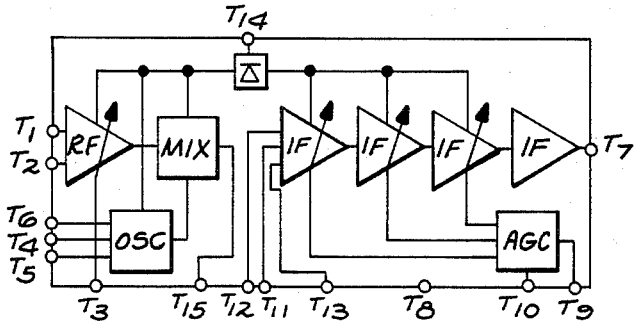
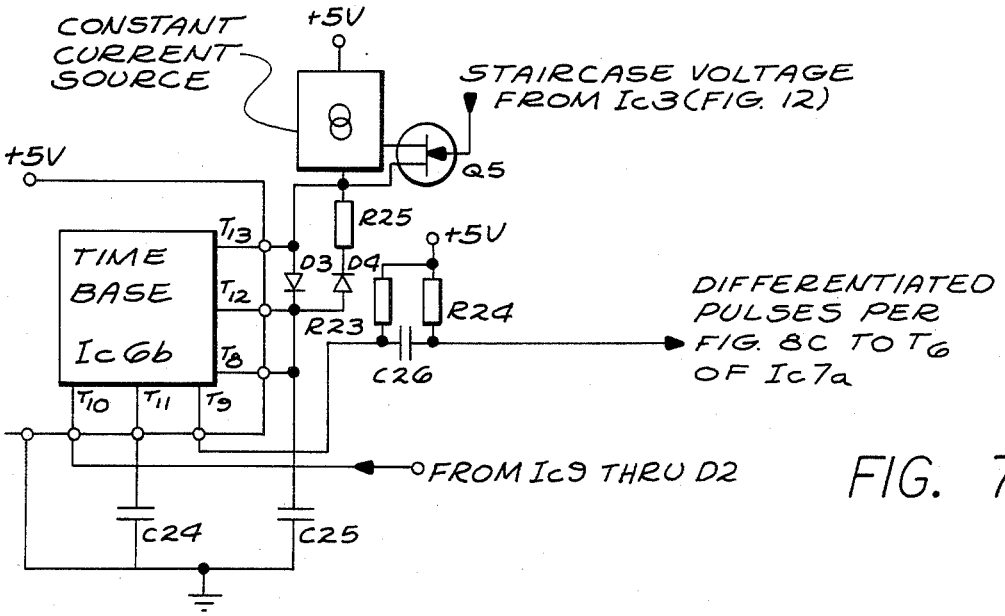
FIG. 7

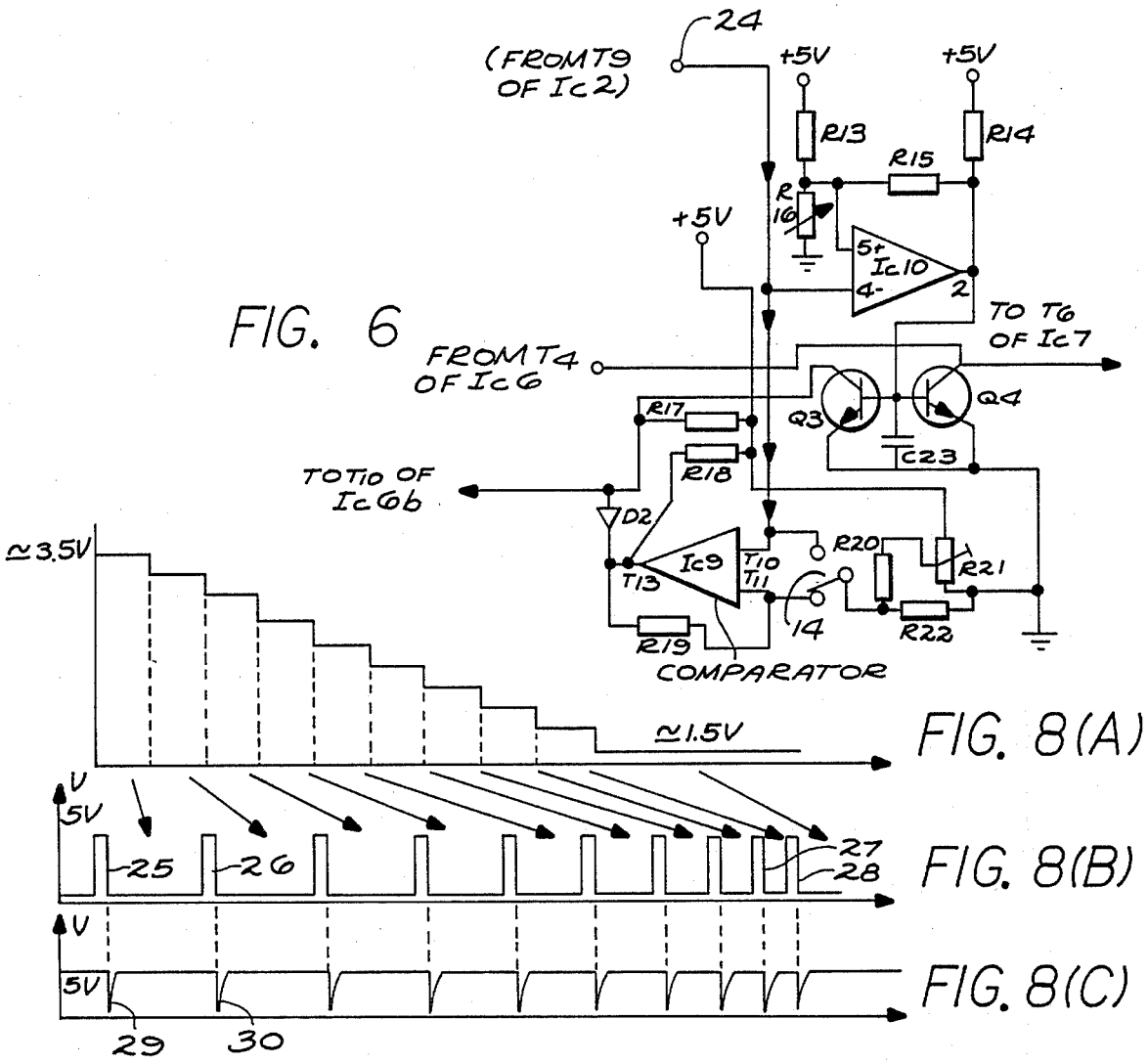
FIG. 6
FIG. 8(A)
FIG. 8(B)
FIG. 8(C)
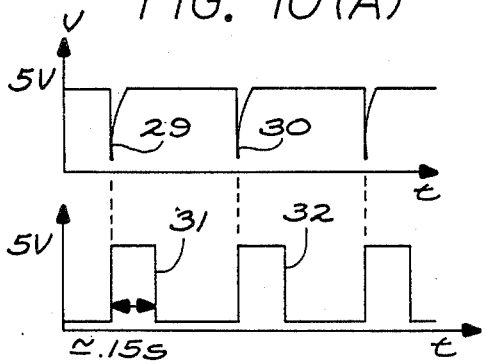
FIG. 10(A)
FIG. 10(B)
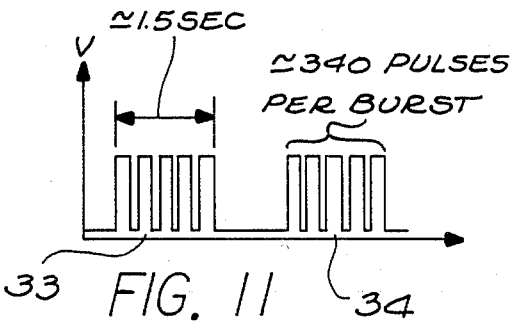
FIG. 11

DISTANCE MONITOR ESPECIALLY FOR CHILD SURVEILLANCE

BACKGROUND OF THE INVENTION

The invention relates to electronic distance measurement generally, and more specifically to specialized apparatus for providing indicia at a receiving location of range to an unmodulated transmitter.

It has long been well known that, for a given emitted signal strength from a radio transmitter, the signal magnitude at a receiving location decreases as the square of the distance between transmitter and receiver. Practical receivers for general purpose use always incorporate automatic gain control circuitry (AGC) so that received signal energy results in substantially the same output from the receiver.

Such AGC arrangements are particularly important where the receiver is mobile, as for example in automobile receivers, since the received radio frequency signal strength varies as distance between transmitter and receiver changes and as a result of other factors.

One particular prior art system based on the processing of a receiver AGC signal to provide distance indication at a receiving location in a personal surveillance arrangement is disclosed in German patent (Offenlegungeschrift) No. 2913563 issued Oct. 16, 1980. In that reference, a transmitted signal is demodulated, the AGC receiver signal is compared to a threshold, and if the AGC magnitude indicates a range between transmitter and receiver exceeding a threshold, an indication is given. Modulation or coding of the transmitted signal in that system is not directly related to the distance determination.

Prior art systems presently known d not appear to address the need for active distance monitoring, i.e., provision of progressively changing distance information so that a range value exceeding a predetermined threshold can be anticipated. Effective surveillance depends on trend or progressive information not provided by simple reliance on prior art systems which merely indicated that a range threshold has been exceeded.

The manner in which the invention improves and adds to the state of the prior art to produce a much improved device for the purpose will be understood as this specification proceeds.

SUMMARY OF THE INVENTION

The invention will be described as a child monitoring system, a field of its major utility, although it is to be understood that it could as well be applied to surveillance of the movements of other persons or mobile objects.

The apparatus (system) of the invention comprises an unmodulated transmitter of constant low power which is carried by a child or attached appropriately to the child's clothing in such a way as to be relatively safe from intentional or accidental removal. The transmitter may even be moulded into a belt worn by the child. The transmitter in practical form would be a state-of-the-art battery powered circuit implemented in solid-state electronics. Thus it can be very small and lightweight. Such a transmitter is readily constructed by persons of skill in this art according to those criteria.

The receiver/monitor is also preferably implemented in solid-state, however, since it would normally be in a fixed indoor location where some person, such as a child's mother could observe it, battery power would be optional. The ordinary A.C. circuit powering would suffice.

The receiver generates an AGC signal as an output and this signal is supplied to the monitor circuitry which detects its level and generates appropriate audible and visual indications as a function of that level.

The receiver/monitor includes an audible beep generator and an LED array presenting a progressive display of one or more LED bars proportional to distance.

The audible indications are in the form of " beeps" (tone bursts) having a low repetition period (1½ seconds, for example) as long as the level of the AGC signal does not exceed a level corresponding to a circle of range between transmitter and receiver not exceeding a predetermined threshold. That portion of the system operation may be called mode 1 (standby) and the slow " beep" rate provides reassurance of continuous operation of the system.

Mode 2 of system operation initiates when the predetermined range circle and the corresponding receiver AGC signal magnitude are exceeded. In this mode the circuits responsive to the AGC signal are activated to produce a quickening of the audible tone bursts (beeps) and initially the first LED bar of the visual LED array flashes at the same rate as the audible " beeps". If the range increases further, the beep rates continue to increase and LED bars flash further along the array flash. Finally, if the maximum predetermined range is exceeded, the final LED bar lights continuously and the beeps merge into a single strident tone indicating an out-of-range condition.

The details of a representative implementation of the device according to the invention will be understood as this specification proceeds.

BRIEF DESCRIPTION OF THE DRAWINGS

FIG. 3 is a circuit diagram of a transmitter for use in the system of the invention.

FIG. 5 is a more detailed circuit diagram of the solid-state chip within the receiver block of FIG. 4.

FIG. 6 is a circuit diagram of the status determining circuits responsive to the AGC signal output of the AM receiver of FIG. 4.

FIG. 7 is a time base circuit within the alarm generation block of FIG. 2 for controlling the visual and audible indications in the visual alarm and acoustical alarm blocks of FIG. 2.

FIGS. 8A, B and C are waveform diagrams respectively representing the staircase voltage, the timing pulses generated from the staircase and the trigger pulses generated from the timing pulses to produce LED flashes and audible tone bursts.

FIGS. 10A and 10B are, respectively, the trigger pulses of FIG. 8C and the resulting tone burst gating signals.

FIG. 11 represents a typical tone burst format gated into operation in the circuit of FIG. 9.

DETAILED DESCRIPTION

Figure 1:
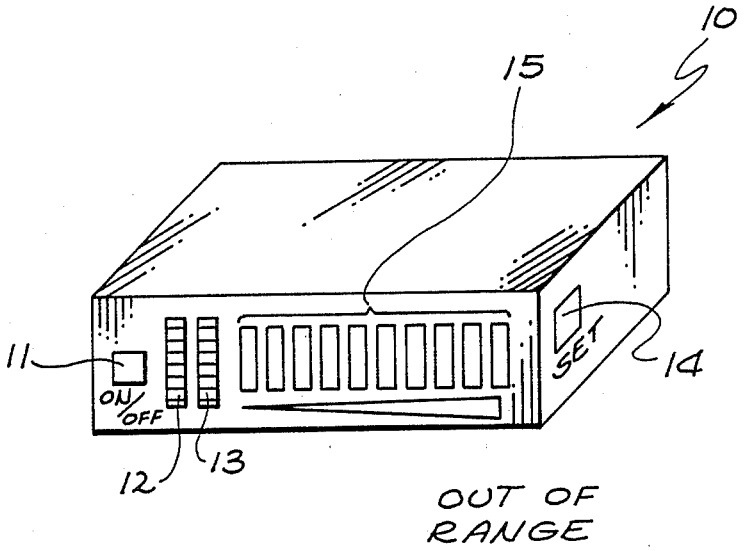
FIG. 1 is an isometric representation of a typical receiver/monitor according to the invention.

Referring to FIG. 1, a typical receiver/monitor package is depicted at 10. An on/off switch is provided at 11. A thumb operated volume control 12 sets the loudness level of the audible beeps and another thumb wheel control at 13 sets the distance limit (threshold) when "Set" switch 14 is activated. The LED array 15 provides a plurality of LED bars as previously identified. The LED bars operate from a first warning level (1 bar activated) to a final out-of-range bar as the transmitter to receiver range increases.

Figure 2:
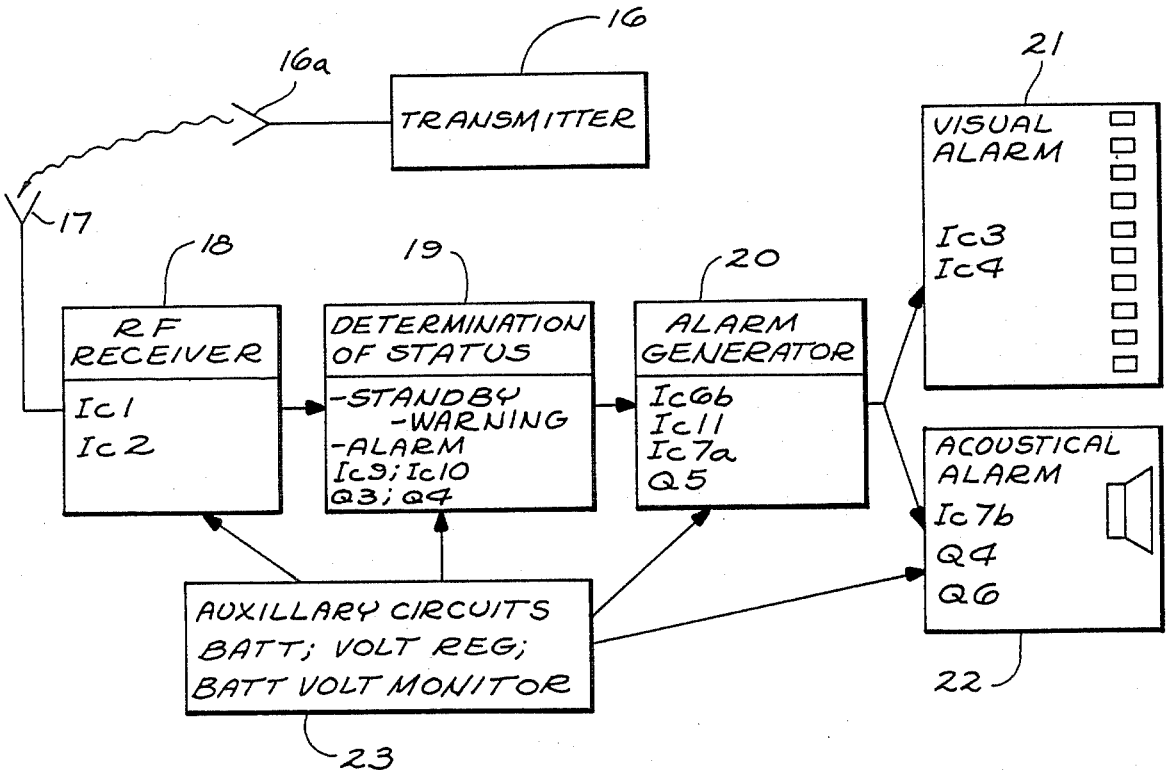
FIG. 2 is an overall block diagram of a system according to the invention.

Referring now to FIG. 2, the unmodulated carrier transmitter 16 is shown in block diagram form and in FIG. 3 in detailed circuit form. The RF receiver block 18 of FIG. 2 is shown in circuit detail in FIG. 4.

The transmitter 16 (and conventional antenna 16A) will be seen to be a simple arrangement of an unmodulated unit having a crystal oscillator Q1 and a buffer-/amplifier Q2. This type of transmitter is entirely conventional and can readily be constructed from FIG. 3 given the ordinary skill of the art. The 27.145 MHZ R.F. output is typically at the level of 8 milliwatts, consistent with U.S. Federal Communications Commission regulations for unlicensed operation. The auxillary circuits of block 23 are entirely conventional and may be of any known form providing the regulated voltages needed and allowing voltage monitoring.

If, as suggested hereinbefore, the transmitter 16 is moulded into or securely attached to a belt worn by the child being monitored (with access for battery replacement), the opportunity for incorporating the antenna 17 into the belt is also extant. Accordingly, the assembly worn by the child is integral and minimum attention is required for its attachment or removal.

The typical circuit parameters for the transmitter of FIG. 3 are given as follows in Table I.

TABLE I

| Component | Value or Type |
|---|---|
| Transistor Q1 | 2N 3866 |
| Transistor Q2 | 2N 3866 |
| Capacitor C1 | 2.2 nf |
| Capacitor C2 | 65 pf |
| Capacitor C3 | 1 nf |
| Capacitor C4 (var.) | 5/40 pf |
| Capacitor C5 (var.) | 5/40 pf |
| Capacitor C6 | 1 nf |
| Capacitor C7 | 1 nf |
| Capacitor C8 (var.) | 5/40 pf |
| Resistor R1 | 47K ohms |
| Resistor R2 | 10K ohms |
| Resistor R3 | 560 ohms |
| Resistor R4 | 47K ohms |
| Resistor R5 | 10K ohms |
| Resistor R6 | 270 ohms |
| Resistor R7 | 270 ohms |
| Inductance L1 (var.) | ±0.4 uh |
| Inductance L2 | 0.4 uh |
| Inductances L3 & L4 | R.F. Chokes |
| Inductance L5 | Resonating inductor |
| Quartz crystal CR1 | 27.145 MHZ |

Trimming of C4, C5 and C8 and tuning of L1 effect optimization of the oscillator operation at the crystal controlled frequency of 27.145 MHZ.

Figure 4:
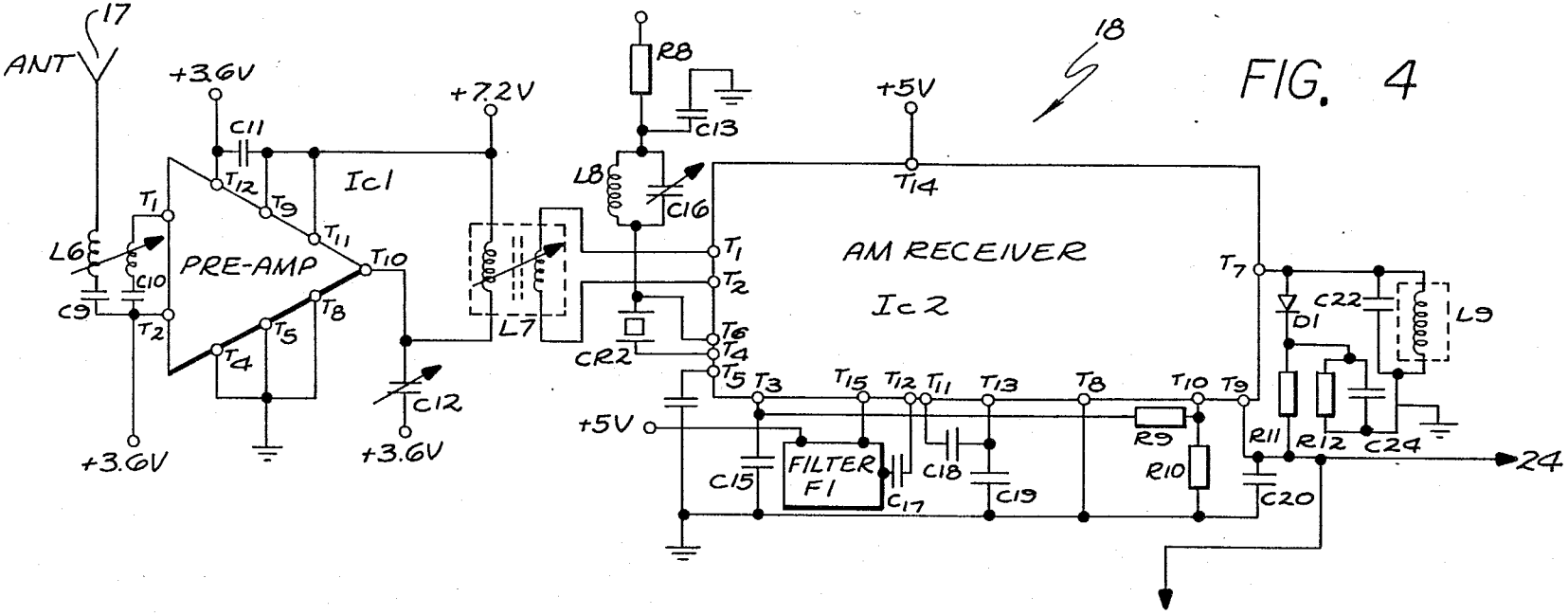
FIG. 4 is a circuit diagram of the receiver portion of the receiver/monitor according to the invention.

Referring now to FIG. 4, the receiver 18 components are depicted in detail. Pre-amplifier Ic1 is an integrated circuit, responding to the transmitted carrier intercepted by the receiving antenna 17 and providing an amplified carrier frequency signal through a coupled R.F. transformer L7 to the main receiver integrated circuit Ic2. The coupled inductor L6 with variable coupling, in cooperation with Capacitors C9 and C10 as shown, provides a substantial degree of tuning at the input of Ic1 consistent with the received transmitter signal.

The variable coupler L7 facilitates adjustment of the signal amplitude into the AM receiver chip Ic2. The piezoelectric crystal CR2 controls the local oscillator within Ic2 to the proper offset frequency for normal superheterodyne operation.

As the circuits of FIG. 4 are discussed, it will be helpful to refer to FIG. 5 which further defines the structural and functional aspects of Ic2. Since Ic2 is a generalized receiver chip, the local oscillator frequency setting circuits, mainly CR2, must be external to Ic2 as indicated.

The IF frequency employed is 455 KHZ and the local oscillator frequency is 26.69 MHZ (since the received R.F. is at 27.145 MHZ).

Figure 4B:
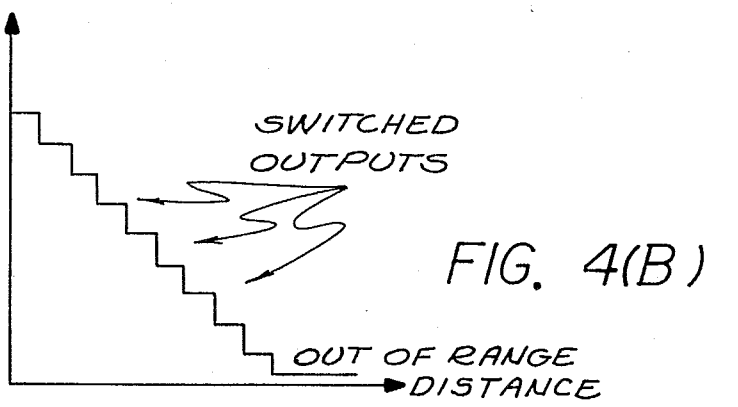
FIG. 4(B) illustrates step quantization of the ACG signal represented in FIG. 4(A) for purposes of subsequent display circuitry.
Figure 4A:
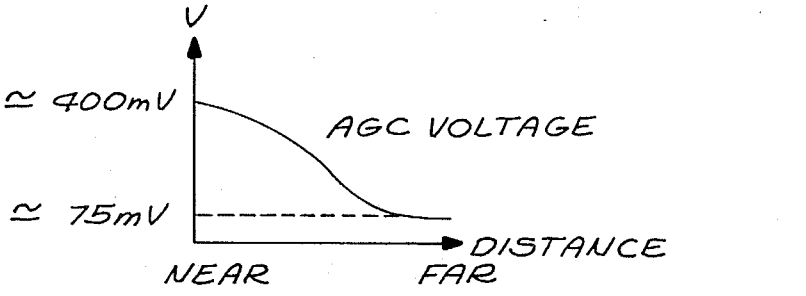
FIG. 4(A) is a graph of a typical AGC voltage generated in the receiver of FIG. 4 as a function of distance.

The integrated circuit chips employed in the circuits of FIG. 4 and in other circuits to be hereinafter described are industry standard items and their terminals are numbered and proceeded by "T" (abbreviation for "terminal") in the figures associated with this specification so that they will not be confused with other element call-outs used. The terminals of Ic2 are consistently identified in FIG. 4 and 5. From FIG. 5 it will be realized that four stages of IF amplification are employed, the first three being gain controllable. The IF gain control signal is that extant at 24 on FIG. 4 as generated through detector diode D1. Thus the signal at 24 is the AGC signal having a value which is a function of received signal strength. That received signal strength and the AGC signal, are inverse functions of distance as shown in FIG. 4(A). The voltage values (max.& min.) on FIG. 4(A) are consistent with the circuit elements of the typical embodiment herein disclosed and described.

Typical circuit parameters for FIG. 4 are as follows in Table II.

TABLE II

| Component | Value or Industry Designation |
|---|---|
| Int. circuit Ic1 | CA 3005 |
| Int. circuit Ic2 | TCR 440 |
| Inductance L6 | Variably coupled R.F. transformer |
| Inductance L7 | Variably coupled R.F. transformer |
| Inductance L8 | Inductor to resonate W/C16 |
| Inductance L9 | Inductor to resonate W/C22 |
| Capacitor C9 | 0.1 ufd |
| Capacitor C10 | 5/20 pf (variable) |
| Capacitor C11 | 47 uf |
| Capacitor C12 | 5/20 pf (variable) |
| Capacitor C13 | 0.1 ufd |
| Capacitor C14 | 47 ufd |
| Capacitor C15 | 0.0013 uf |
| Capacitor C16 | 5/20 pf (variable) |
| Capacitor C17 | 0.1 uf |
| Capacitor C18 | 10 uf |
| Capacitor C19 | 0.0013 uf |
| Capacitor C20 | 1.3 nf |

TABLE II-continued

| Component | Value or Industry Designation |
|---|---|
| Capacitor C21 | 0.47 uf |

TABLE II

| Component | Value or Industry Designation |
|---|---|
| Capacitor C22 | 22 uf |
| Resistor R8 | 47K ohms |
| Resistor R9 | 10K ohms |
| Resistor R10 | 620 ohms |
| Resistor R11 | 12K ohms |
| Resistor R12 | 1K ohms |
| Diode D1 | Detector (rectification diode) |

In FIG. 4, the filter F1, will be seen to be essentially in series with the signal path between the Ic2 mixer output and the IF chain (see FIG. 5). Extraneous received signals are thus deemphasized, the center frequency of F1, being at the 455 KHZ IF.

Figure 12:
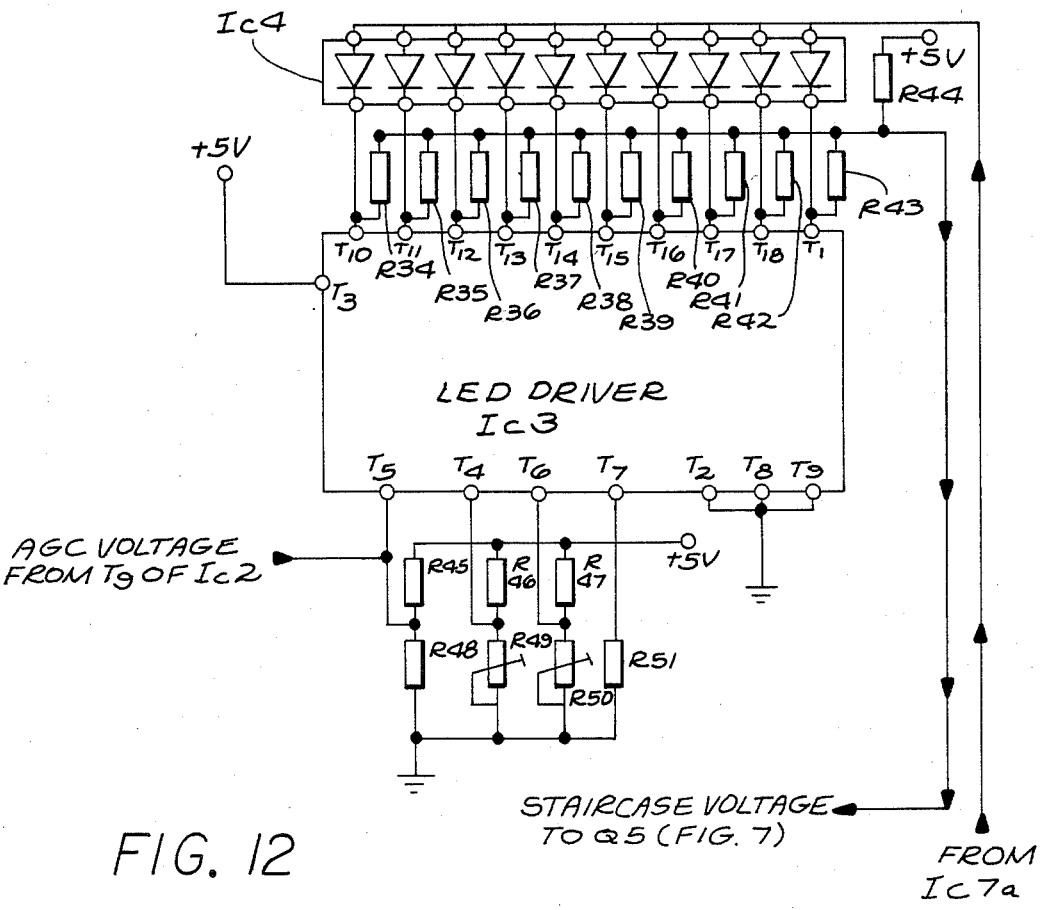
FIG. 12 is a circuit digram of the LED array and driver.

Referring back to FIG. 2, the block 19 will be seen to comprise the circuitry of FIG. 6 and related circuits of FIGS. 7 and 12. Accordingly the description hereinafter will require reference to all of these figures as indicated.

In the first two modes of operation, namely when the system is in the stand-by or warning mode, the range limits (thresholds) for each of these modes are determined jointly by the aforementioned AGC signal (from 24 of FIG. 4) and the setting of the tap of the potentiometer R21 (FIG. 6).

The "set" switch S1 (14 on FIG. 1), is preferably a momentary SPDT switch illustrated in the released (operate) position in which it applies the warning threshold voltage from R21 to terminal 11 of Ic9 where it is compared to the varying AGC voltage (from Ic2 terminal 9) applied at Ic9 terminal 10.

The warning (out-of-range) threshold is set by the tap of potentiometer R16. In this mode, the AGC voltage falls below that at the tap of R21 and the Ic9 output goes high (5 volts), which is applied to reset pin 10 of time base generator Ic6b (FIG. 7). This starts the time base ciruit Ic6b (FIG. 7). Previously, i.e., when the AGC voltage is relatively high (transmitter nearby), Ic6b is quiescent (off) and the stand-by mode is extant.

The "alarm" "out-of-range" mode is activated when the distance separating the transmitter and receiver (monitor) location exceeds a second predetermined threshold represented by the tap setting of R16. In this mode the AGC voltage (24) falls below the limit set by R16 at terminal 5 of Ic10. The output of Ic10 then goes high, grounding the collectors of Q4 and Q3. This keeps the output of Ic7a high as long as the Ic10 output is high. This activates the "maximum" LED bar to indicate "out-of-range". Contemporaneously the audible alarm emits a continuous tone.

A staircase voltage waveform according to FIG. 8A is generated by Ic3, the LED driver (FIG. 12) and applied through Q5 (FIG. 7) to terminal 6 of Ic7a. The steps of this staircase range from an initial level of approximately 3.5 volts down to approximately 1.5 volts in equal down steps of equal duration. The FIG. 8A staircase is also applied to the base of Q5 which is of the FET type used as a voltage-controlled resistor. The variation of voltage on the base of Q5 varies the channel resistance of Q5. The effective channel resistance of Q5 controls the charging rate of C25 (FIG. 7). Each downward step of the staircase voltage increases the current through Q5 and D3 into C25, this in turn shortening the effective time constant and shortening the time between pulses of Ic6b. This effect is depicted on FIG. 8B.

The pulses represented at FIG. 8B are differentiated by R24 and C26 as a series RC network and constitute the output of the circuit of FIG. 7 (FIG. 8C waveform).

The pulses represented at FIG. 8C are triggers spaced as a function of the staircase voltage (FIG. 8A) instantaneous level through operation of the FIG. 7 circuit.

In the standby mode (transmitter close to receiver) the output of Ic9 (FIG. 6) to Ic6 is effectively at ground potential disabling Ic6b. In the alarm mode the Q3 collector (FIG. 6) is grounded also disabling IC6b. In the warning mode, the collector of Q3 is high permitting time base generator Ic6b to operate. Thus only in the warning mode is the progressive (proportional to range) LED display lighting effected.

The pulses according to FIG. 10A from Ic6b are applied to T6 (trigger input) of Ic7a which responds as a monostable multivibrator or gate generator providing gates of approximately 0.15 seconds duration to the LED array Ic4. At each negative going (leading edge) of the trigger waveform pulses, the output T5 of Ic7a goes high for about 0.15 seconds forming a series of gates of approximately 0.15 seconds duration. It will be realized that the trigger pulses of FIG. 10A are the same as those of FIG. 8C, but are repeated at FIG. 10A to associate them with the gating signals of FIG. 10B.

Figure 9:
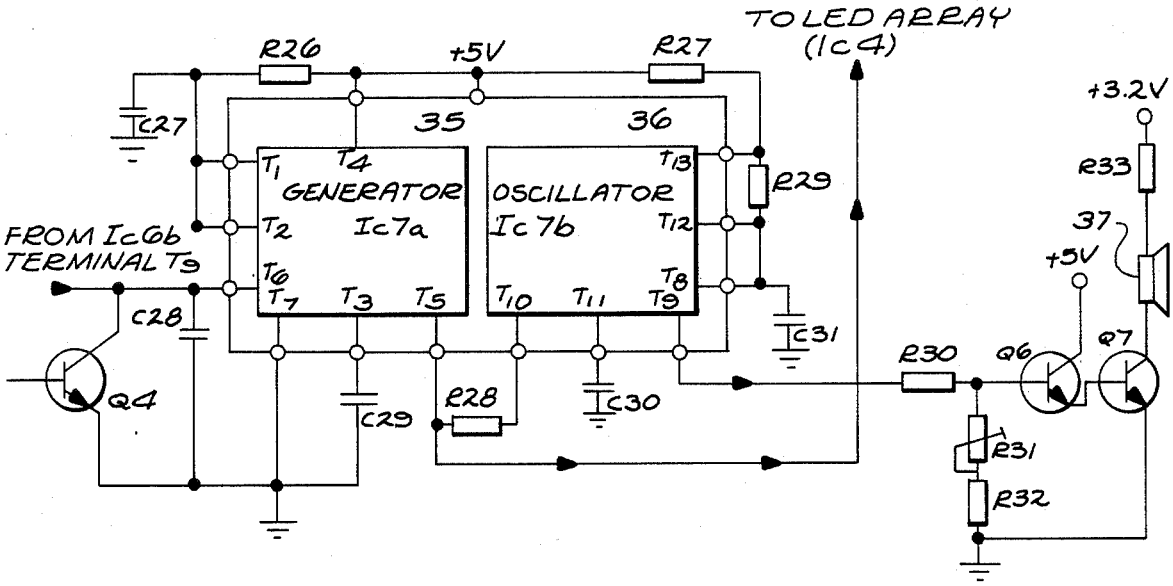
FIG. 9 is a circuit diagram of the LED flash and audible tone burst generator responsive to the waveform of FIG. 8C.

Each 0.15 second gating signals (FIG. 10B) is applied to the LED array (Ic4) as indicated and contemporaneously to the audible alarm 37 via Q6 and Q7 as a current driver (power amplifier circuit) for the ceramic transducer 37. Thus the visual warnings and tone bursts are synchronized. In FIG. 9, the gating signals generated at T5 of Ic7a are routed to Ic4 and into the 2280 HZ oscillator Ic7b. This oscillator provides approximately 340 pulses per gate from Ic7a. The sound transducer 37 responds to these pulses as audible tone 0.15 second bursts of a basic 2280 HZ frequency. The variable resistor R31 provides variable voltage division at its junction with R30 to control the amplitude into the base of Q6, this being a volume control for the audible warning signal emitted by transducer 37.

When the system goes into mode 3 (alarm), the Q4 collector goes down grounding out the triggers to Ic7b, but the output at T9 of Ic7b stays high, resulting in a continuous audible alarm and full LED array illumination.

In the standby mode, on the other hand, no pulses are provided by Ic6b and no sound or LED illumination results.

Referring now to FIG. 12, the LED array Ic4 is illustrated connected to the LED driver Ic3. The AGC voltage input to T5 of Ic3 is understood to be the AGC voltage as modified by the "distance set" controls previously discussed. This signal is compared within Ic3 to the respective higher and lower limits at T4 and T6 of Ic3. Since the AGC voltage is predetermined to vary from 75 mv. to 400 mv., the lower limit is set by R49 to be 75 mv. at T4 of Ic3 and the upper limit to slightly less than 400 mv. (for example, 390 mv.). Ic3 internally divides this difference (390-75 or 315 millivolts) into nine 35 mv. steps. Each 35 mv. downward step (waveform of FIG. 4B) then switches on the LED bars successively. Ic3 also switches on one of the voltage divider resistors (R34 thru R43) so that the externally supplied staircase signal of FIG. 4B is generated at the common connection of these voltage divider resistors.

Table III following sets forth the typical circuit parameters for the circuit of FIG. 6.

TABLE III

| Component | Value or Industry Standard | Component | Value or Industry Standard |
|---|---|---|---|
| Int. circuit Ic9 | LM 339 | Resistor R19 | 33K ohms |
| Int. circuit Ic10 | LM 339 | Resistor R20 | 47K ohms |
| Transistor Q3 | 2N 3866 | Resistor R21 | 1K ohms (variable) |
| Transistor Q4 | 2N 3866 | Resistor R22 | 8.2K ohms |
| Resistor R13 | 47 ohms | Capacitor C23 | 0.1 uf |
| Resistor R14 | 1.2 megohms | D-2 | diode |
| Resistor R15 | 18K ohms | | |
| Resistor R16 | 1K ohms (var.) | | |
| Resistor R17 | 12K ohms | | |
| Resistor R18 | 100K ohms | | |

Table IV following gives typical circuit parameters for the circuit of FIG. 7.

TABLE IV

| Component | Value or Industry Standard |
|---|---|
| Int. circuit Ic6 | XR 556 |
| Transistor Q5 | FET |
| Capacitor C24 | 47 uf |
| Capacitor C25 | 47 uf |
| Capacitor C26 | 1.3 nf |
| Resistor R23 | 39K ohms |
| Resistor R24 | 1.8K ohms |
| Resistor R25 | 1.5K ohms |

Table V following gives typical circuit parameters for the circuit of FIG. 9.

TABLE V

| Component | Value or Industry Standard | Component | Value or Industry Standard |
|---|---|---|---|
| Int. circuit Ic7 | XR 556 | Resistor R26 | 2.7K ohms |
| Transistor Q4 | 2N 3866 | Resistor R27 | 100K ohms |
| Transistor Q6 | 2N 3866 | Resistor R28 | 47K ohms |
| Transistor Q7 | 2N 2866 | Resistor R29 | 1.2 Megohms |
| Capacitor C27 | 47 uf | Resistor R30 | 1.2 Megohms |
| Capacitor C28 | 0.1 uf | Resistor R31 | 1K ohms (variable) |
| Capacitor C29 | 0.1 uf | Resistor R32 | 100K ohms |
| Capacitor C30 | 0.1 uf | Resistor R33 | 62K ohms |
| Capacitor C31 | 47 nf | | |

Table VI following lists typical circuit parameters for the circuit of FIG. 12.

TABLE VI

| Component | Value or Industry Standard | Component | Value or Industry Standard |
|---|---|---|---|
| Int. circuit Ic3 | LML 914 | Resistor R42 | 1K ohms |
| Int. circuit Ic4 | LML 914 | Resistor R43 | 180 ohms |
| Resistor R34 | 24K ohms | Resistor R44 | 240 ohms |
| Resistor R35 | 18K ohms | Resistor R45 | 1.3K ohms |
| Resistor R36 | 15K ohms | Resistor R46 | 1.3 Megohms |
| Resistor R37 | 13K ohms | Resistor R47 | 420K ohms |
| Resistor R38 | 12K ohms | Resistor R48 | 330K ohms |
| Resistor R39 | 8.2K ohms | Resistor R49 | 50K ohms (variable) |
| Resistor R40 | 6.5K ohms | Resistor R50 | 50K ohms (variable) |
| Resistor R41 | 3.3K ohms | | |

The skilled reader may envision certain variations and modifications of the specific structure disclosed. It is not intended that the scope of the invention should be considered to be limited by the drawings on this specification, these being typical and illustrative only.

What is claimed is:

1. A system for monitoring the position of a person with respect to a monitoring location and for providing at least a visual indication as a function of said position, comprising:

first means including a radio-frequency transmitter associated with said person to be monitored, for radiating radio-frequency waves;

second means including a radio-frequency receiver located at said monitoring location for substantially continuously receiving said radio-frequency waves;

third means within said second means for generating a receiver automatic gain control signal;

a visual distance indicating display comprising N discrete light emitting elements and including circuits for energizing from one to N of said light emitting elements corresponding to the level of said automatic gain control signal at any time, said circuits also being arranged to cause said light emitting elements energized at any one time to flash at a predetermined flash rate as a function of the level of said automatic gain control signal.

2. A system according to claim 1 in which said circuits for energizing said light emitting elements are arranged to effect said flash rate at rate increasing as a function of the number of said light emitting elements energized at any one time.

3. A system according to claim 1 further including a beep tone generator associated with said third means and responsive to said circuits for energizing said light emitting elements to produce a beep repetition rate of said tone generator substantially contemporaneous with said flash rate.

4. A system according to claim 1 in which said light emitting elements are light emitting diodes arranged in a linear array displayed at said monitoring location.

* * * * *